US005930847A

United States Patent [19]

Hall

[11] Patent Number: 5,930,847

[45] Date of Patent: Aug. 3, 1999

[54] TOILET SCREEN

[76] Inventor: George Hall, 6018 S. Sawyer, Chicago, Ill. 60629

[21] Appl. No.: 08/954,775

[22] Filed: Oct. 22, 1997

[51] Int. Cl.[6] ..... E03D 9/00

[52] U.S. Cl. ..... 4/300.3

[58] Field of Search ..... 4/222.1, 300.3

[56] References Cited

U.S. PATENT DOCUMENTS 3,212,104 10/1965 Stevens ..... 4/300.3

FOREIGN PATENT DOCUMENTS 8105829 7/1983 Netherlands ..... 4/300.3

*Primary Examiner*—Robert M. Fetsuga

[57] ABSTRACT

A toilet screen is provided including a screen assembly situated over a large circular opening of a commode and having a closed orientation for precluding large articles to pass through the opening and an open orientation for allowing large articles to pass therethrough. Also included is at least one actuator assembly for maintaining the screen assembly in the closed orientation when a commode lid is opened and in the open orientation when the commode lid is closed.

4 Claims, 2 Drawing Sheets

TOILET SCREEN

BACKGROUND OF THE INVENTION

1. Field of the Invention

The present invention relates to stationary toilet screens for urinals and more particularly pertains to a new toilet screen for preventing large articles from stopping up a commode.

2. Description of the Prior Art

The use of to stationary toilet screens for urinals is known in the prior art. More specifically, to stationary toilet screens for urinals heretofore devised and utilized are known to consist basically of familiar, expected and obvious structural configurations, notwithstanding the myriad of designs encompassed by the crowded prior art which have been developed for the fulfillment of countless objectives and requirements.

Known prior art to stationary toilet screens for urinals include U.S. Pat. No. 4,574,403; U.S. Pat. No. 5,313,67; U.S. Pat. Des. 258,181; U.S. Pat. No. 4,670,918; U.S. Pat. Des. 258,472; and U.S. Pat. No. 5,365,616.

In these respects, the toilet screen according to the present invention substantially departs from the conventional concepts and designs of the prior art, and in so doing provides an apparatus primarily developed for the purpose of preventing large articles from stopping up a commode.

SUMMARY OF THE INVENTION

In view of the foregoing disadvantages inherent in the known types of to stationary toilet screens for urinals now present in the prior art, the present invention provides a new toilet screen construction wherein the same can be utilized for preventing large articles from stopping up a commode.

The general purpose of the present invention, which will be described subsequently in greater detail, is to provide a new toilet screen apparatus and method which has many of the advantages of the to stationary toilet screens for urinals mentioned heretofore and many novel features that result in a new toilet screen which is not anticipated, rendered obvious, suggested, or even implied by any of the prior art to stationary toilet screens for urinals, either alone or in any combination thereof.

To attain this, the present invention generally comprises a commode with a bowl portion having a hollow hemispherical configuration. Such bowl portion of the commode has a top periphery and a large circular opening situated at a lower extent thereof. The large circular opening is connected to a sewer line, as is conventional. Associated therewith is a commode lid having a disk-shaped configuration with a top face, a bottom face, and a periphery formed therebetween. The periphery of the commode lid is hingably coupled to the periphery of the commode and is adapted to pivot between a closed orientation with the lid covering the bowl portion of the commode and an open orientation for remaining vertically orientated to allow use of the commode. As shown in FIGS. 2 & 4, a screen assembly is provided including an mounting ring adhered to an interior surface of the bowl portion of the commode. The mounting ring resides in concentric relationship with the large circular opening. A large planar screen defining one half of a disk has an arcuate portion of a periphery thereof fixedly coupled to the mounting ring. During use, the large planar screen is situated above a front extent of the large circular opening. A pair of discrete small planar screens each define one quarter of a disk. An arcuate portion of a periphery of each small planar screen is hingably coupled to the mounting ring and situated above a rear extent of the large circular opening. In operation, the small planar screens each are only pivotable between a closed orientation with a linear portion of the periphery thereof abutting a linear portion of the periphery of the large planar screen and an open orientation. In the open orientation, both small planar screens depend downwardly below the large planar screen thereby allowing large articles to pass therethrough. Also included is a pair of actuator assemblies each including an elongated linear rod. Such rods each have a first end pivotally coupled to a side extent of the bottom surface of the commode lid and a second end with a coiled spring coupled thereto. A bottom end of the coiled spring of each actuator assembly is connected to an associated one of the small planar screens for maintaining the small planar screens in the closed orientation when the commode lid is opened and in the open orientation when the commode lid is closed.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new toilet screen apparatus and method which has many of the advantages of the to stationary toilet screens for urinals mentioned heretofore and many novel features that result in a new toilet screen which is not anticipated, rendered obvious, suggested, or even implied by any of the prior art to stationary toilet screens XXXX 00

It is another object of the present invention to provide a new toilet screen which may be easily and efficiently manufactured 088 and marketed.

It is a further object of the present invention to provide a new toilet screen which is of a durable and reliable construction.

An even further object of the present invention is to provide a new toilet screen which is susceptible of a low cost of manufacture with regard to both materials and labor, and which accordingly is then susceptible of low prices of sale to the consuming public, thereby making such toilet screen economically available to the buying public.

Still yet another object of the present invention is to provide a new toilet screen which provides in the apparatuses and methods of the prior art some of the advantages thereof, while simultaneously overcoming some of the disadvantages normally associated therewith.

Still another object of the present invention is to provide a new toilet screen for preventing large articles from stopping up a commode.

Even still another object of the present invention is to provide a new toilet screen that includes a screen assembly situated over a large circular opening of a commode and having a closed orientation for precluding large articles to pass through the opening and an open orientation for allowing large articles to pass therethrough. Also included is at least one actuator assembly for maintaining the screen assembly in the closed orientation when a commode lid is opened and in the open orientation when the commode lid is closed.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
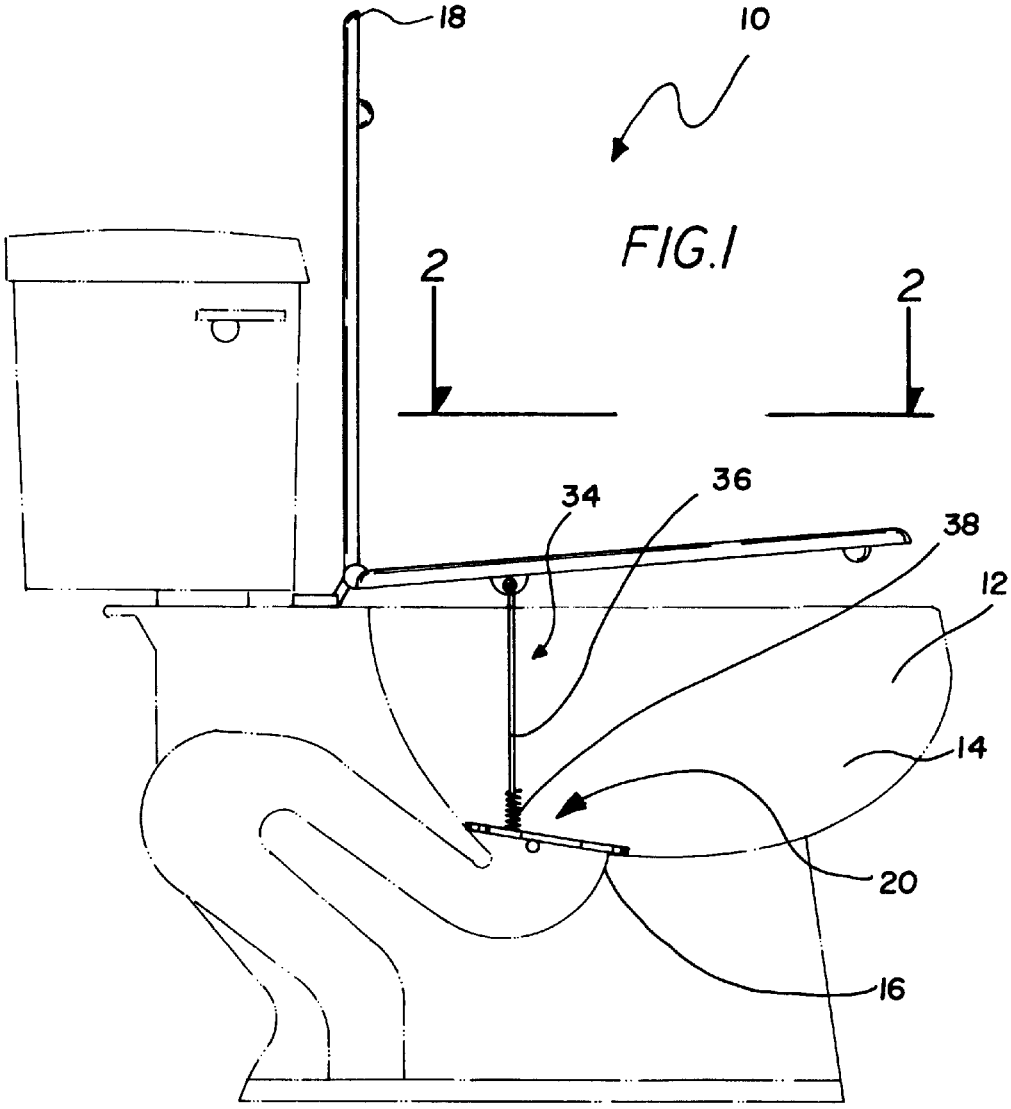
FIG. 1 is a side view of a new toilet screen according to the present invention.

With reference now to the drawings, and in particular to FIGS. 1 through 4 thereof, a new toilet screen embodying the principles and concepts of the present invention and generally designated by the reference numeral 10 will be described.

The present invention, as designated as numeral 10, includes a commode 12 with a bowl portion 14 having a hollow hemispherical configuration. Such bowl portion of the commode has a top periphery and a large circular opening 16 situated at a lower extent thereof. The large circular opening is connected to a sewer line, as is conventional in the art.

Associated therewith is a commode lid 18 having a disk-shaped configuration with a top face, a bottom face, and a periphery formed therebetween. Preferably, the commode lid is closed along the entire top and face thereof in contrast with a conventional toilet seat. The periphery of the commode lid is hingably coupled to the periphery of the commode and is adapted to pivot between a closed orientation with the lid covering the bowl portion of the commode and an open orientation for remaining vertically orientated to allow use of the commode.

Figure 2:
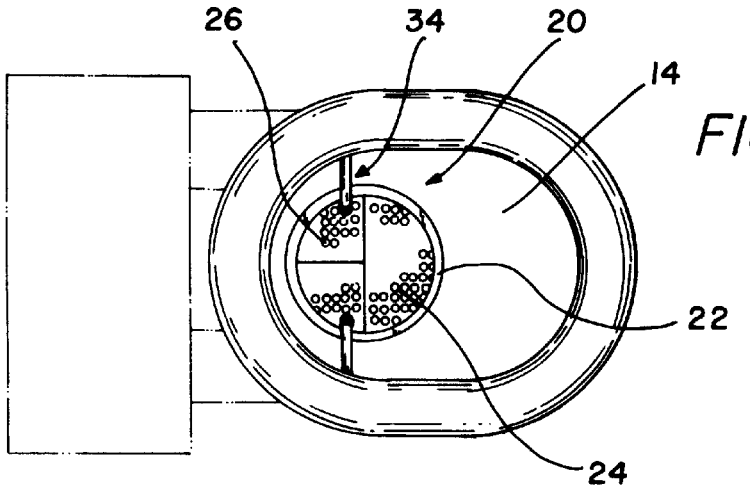
FIG. 2 is a top view of the present invention with a portion of the lid cut away to allow viewing within the toilet.
Figure 4:
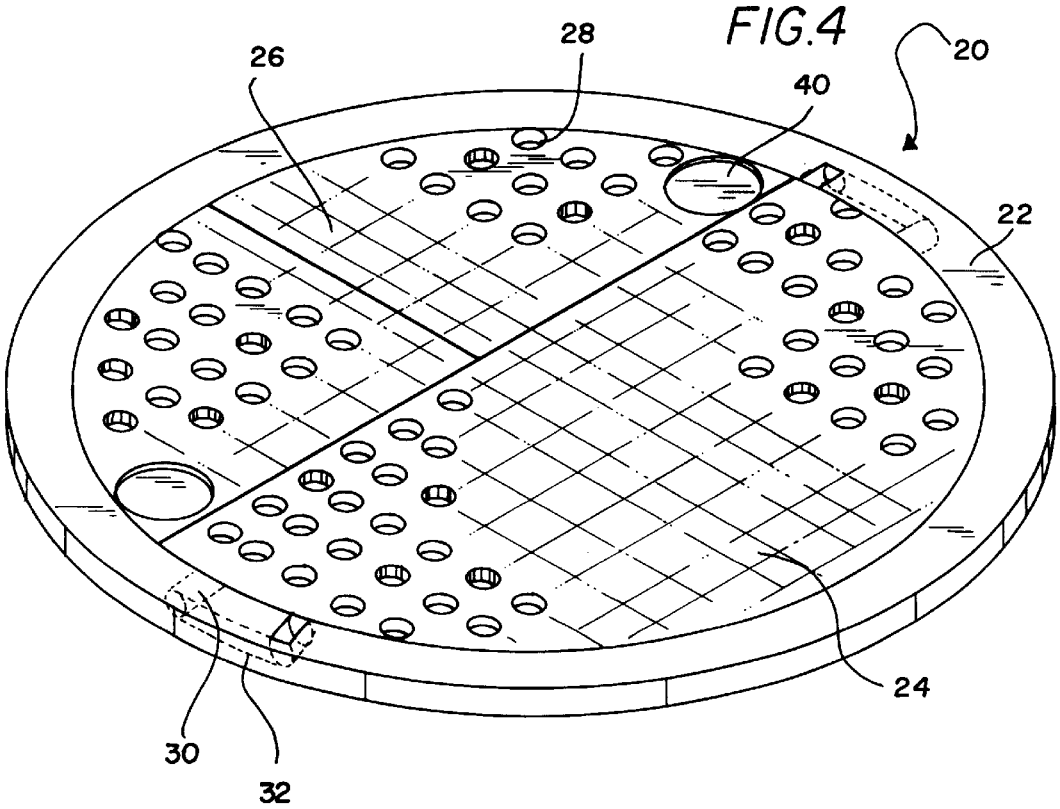
FIG. 4 is a perspective view of the screen assembly of the present invention.

As shown in FIGS. 2 & 4, a screen assembly 20 is provided including an mounting ring 22 adhered to an interior surface of the bowl portion of the commode. The mounting ring may be integrally formed with the commode or a waterproof adhesive may be employed to accomplish the required coupling. The mounting ring resides in concentric relationship with the large circular opening during use. A large planar screen 24 defining one half of a disk has an arcuate portion of a periphery thereof fixedly coupled to the mounting ring. During use, the large planar screen is situated above a front extent of the large circular opening. A pair of discrete small planar screens 26 are provided which each define one quarter of a disk. An arcuate portion of a periphery of each small planar screen is hingably coupled to the mounting ring and is situated above a rear extent of the large circular opening. While not shown, the foregoing hingable coupling may be afforded by way of a flexibly piece of plastic and a pair of stops situated on an upper surface of the mounting ring. It should be noted that the small and large screens each comprises a rigid elastomeric plate with a plurality of small circular bores 28 formed in an entire surface thereof.

In operation, the small planar screens each are only pivotable between a closed orientation with a linear portion of the periphery thereof abutting a linear portion of the periphery of the large planar screen and an open orientation. In the open orientation, the small planar screens depend downwardly below the large planar screen thereby allowing large articles to pass therethrough.

As an option, the large planar screen may be equipped with a pair of posts 30 coaxially misaligned and adapted to be situated within recesses 32 formed in the mounting ring. See FIG. 4. Such structure allows the selective removal of the large planar screen.

Figure 3:
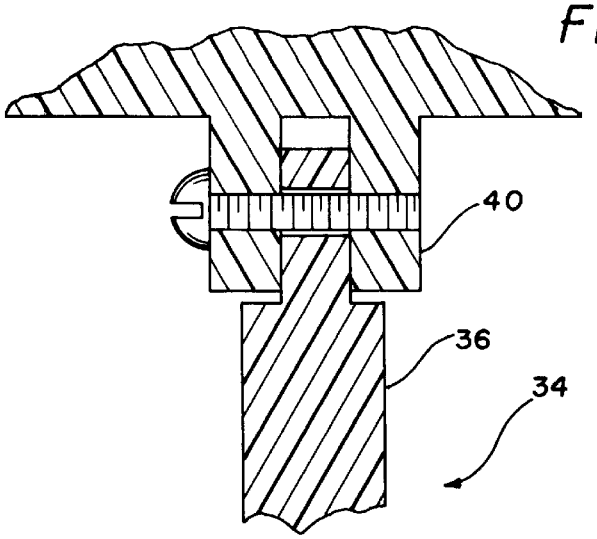
FIG. 3 is a cross-sectional view of the coupling between one of the actuator assemblies and the commode lid of the present invention.

Also included is a pair of actuator assemblies 34 each including an elongated, rigid & linear rod 36. Such rods each have a first end pivotally coupled to a side extent of the bottom surface of the commode lid and a second end with a coiled spring 38 coupled thereto. Such pivotal coupling is preferably afforded by way of a clevis 40, as shown in FIG. 3. A bottom end of the coiled spring of each actuator assembly is connected within a well 40 of an associated one of the small planar screens. The wells 40 of the small planar screens are diametrically opposed for ideal positioning of the actuator assemblies. By this structure, the actuator assemblies are adapted for maintaining the small planar screens in the closed orientation when the commode lid is opened and in the open orientation when the commode lid is closed. The springs are critical for allowing the commode lid to be fully extended to the vertical open orientation thereof.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toilet screen system comprising, in combination:

a commode with a bowl portion with a hollow hemispherical configuration with a top periphery and a large circular opening situated at a lower extent thereof and connected to a sewer line;

a commode lid having a disk-shaped configuration with a top face, a bottom face, and a periphery formed therebetween, the periphery of the commode lid hingably coupled to the periphery of the commode;

a screen assembly including an mounting ring adhered to an interior surface of the bowl portion of the commode in concentric relationship with the large circular opening, a large planar screen defining one half of a disk with an arcuate portion of a periphery thereof fixedly coupled to the mounting ring and situated above a front extent of the large circular opening and a pair of discrete small planar screens each defining one quarter of a disk with an arcuate portion of a periphery thereof hingably coupled to the mounting ring and situated above a rear extent of the large circular opening such that both small planar screens are pivotable only between a closed orientation with a linear portion of the periphery thereof abutting a linear portion of the periphery of the large planar screen and an open orientation with both small planar screens depending downwardly below the large planar screen thereby allowing large articles to pass therethrough; and a pair of actuator assemblies each including an elongated linear rod having a first end pivotally coupled to a side extent of the bottom surface of the commode lid and a second end with a coiled spring coupled thereto, a bottom end of the coiled spring of each actuator assembly connected to an associated one of the small planar screens for maintaining the small planar screens in the closed orientation when the commode lid is opened and in the open orientation when the commode lid is closed.

2. A toilet screen for use with a commode with a bowl portion having a hollow hemispherical configuration with a top periphery and a large circular opening situated at a lower extent thereof and connected to a sewer line, the toilet screen comprising:

a commode pivot member having a disk-shaped configuration with a top face, a bottom face, and a periphery formed therebetween, the periphery of the commode pivot member hingably coupled to the periphery of the commode;

a screen assembly situated over the large circular opening and having a closed orientation for precluding large articles to pass and an open orientation for allowing large articles to pass therethrough; and at least one actuator assembly for maintaining the screen assembly in the closed orientation when the commode pivot member is opened and in the open orientation when the commode pivot member is closed;

wherein the actuator assembly includes an elongated rod connected between the commode pivot member and the screen assembly;

wherein the actuator assembly further includes a spring connected between the rod and at least one of the commode pivot member and the screen assembly for allowing the commode pivot member to be fully extended to the open orientation thereof.

3. A toilet screen as set forth in claim 2 wherein the screen assembly is pivotally coupled with respect to the commode.

4. A toilet screen as set forth in claim 2 wherein the screen assembly includes a fixed portion and a pivoting portion.

* * * * *